US011479280B2

(12) United States Patent
Jovenall

(10) Patent No.: US 11,479,280 B2
(45) Date of Patent: Oct. 25, 2022

(54) REMOTE CONTROL LOCOMOTIVE SYSTEMS AND METHODS

(71) Applicant: Cattron North America, Inc., Warren, OH (US)

(72) Inventor: Jeremy Jovenall, Mercer, PA (US)

(73) Assignee: CATTRON NORTH AMERICA, INC., Warren, OH (US)

( * ) Notice: Subject to any disclaimer, the term of this patent is extended or adjusted under 35 U.S.C. 154(b) by 898 days.

(21) Appl. No.: 16/298,705

(22) Filed: Mar. 11, 2019

(65) Prior Publication Data

US 2020/0269891 A1 Aug. 27, 2020

Related U.S. Application Data

(60) Provisional application No. 62/810,594, filed on Feb. 26, 2019.

(51) Int. Cl.

| | |
|---|---|
| ***B61L 15/00*** | (2006.01) |
| ***B61L 27/40*** | (2022.01) |
| ***B61L 27/57*** | (2022.01) |
| ***B61L 25/02*** | (2006.01) |
| *B61L 27/04* | (2006.01) |

(52) U.S. Cl.

CPC ..... *B61L 15/0081* (2013.01); *B61L 25/028* (2013.01); *B61L 27/40* (2022.01); *B61L 27/57* (2022.01); *B61L 27/04* (2013.01)

(58) Field of Classification Search

None

See application file for complete search history.

(56) References Cited

U.S. PATENT DOCUMENTS

| | | | | |
|---|---|---|---|---|
| 10,759,456 | B2 * | 9/2020 | Mathews | B60T 7/126 |
| 2017/0158213 | A1 * | 6/2017 | Mathews | B61L 3/008 |
| 2017/0274918 | A1 * | 9/2017 | Reynolds | B60T 7/128 |

FOREIGN PATENT DOCUMENTS

| | | | | |
|---|---|---|---|---|
| AU | 2015202191 | B2 * | 4/2016 | B61L 15/0054 |
| DE | 102010011949 | A1 * | 9/2011 | B61L 15/0054 |
| EP | 3476678 | A1 * | 5/2019 | B60T 13/665 |
| JP | 2008222003 | A * | 9/2008 | |

OTHER PUBLICATIONS

Translations of AU 2015202191 (Year: 2016).*

* cited by examiner

*Primary Examiner* — Peter D Nolan
*Assistant Examiner* — Michael F Whalen
(74) *Attorney, Agent, or Firm* — Harness, Dickey & Pierce, P.L.C.; Anthony G. Fussner

(57) ABSTRACT

An example remote control locomotive (RCL) system includes a consist having at least one locomotive and at least one pneumatic brake pipe, and an RCL controller. The RCL controller includes a memory configured to store at least one pressurization reference including correspondence relationships between pneumatic brake pipe pressurization time periods and pneumatic brake pipe air volumes, and a processor configured to monitor a time period to pressurize the at least one pneumatic brake pipe of the consist. The processor is also configured to compare the monitored time period to pressurize the at least one pneumatic brake pipe to the pressurization reference, and determine a fault or a number of locomotives in the consist according to the comparison of the monitored time period to pressurize the at least one pneumatic brake pipe to the pressurization reference.

19 Claims, 5 Drawing Sheets

REMOTE CONTROL LOCOMOTIVE SYSTEMS AND METHODS

CROSS-REFERENCE TO RELATED APPLICATION

This application claims priority to and the benefit of U.S. Provisional Application No. 62/810,594 filed Feb. 26, 2019. The entire disclosure of the above application is incorporated herein by reference.

FIELD

The present disclosure generally relates to systems and methods for remote control locomotives.

BACKGROUND

This section provides background information related to the present disclosure which is not necessarily prior art.

Modern technology is being implemented on freight rail fleets worldwide, but these technology-based systems do not have appropriate data points to accommodate system awareness of connected rolling stock. This is especially true in the yard-switching environment where a list of rolling stock and rolling stock attributes are not communicated to onboard locomotive systems prior to or during operation, and where train makeup changes regularly.

DRAWINGS

The drawings described herein are for illustrative purposes only of selected embodiments and not all possible implementations, and are not intended to limit the scope of the present disclosure.

Corresponding reference numerals indicate corresponding (but not necessarily identical) parts throughout the several views of the drawings.

DETAILED DESCRIPTION

Figure 1:
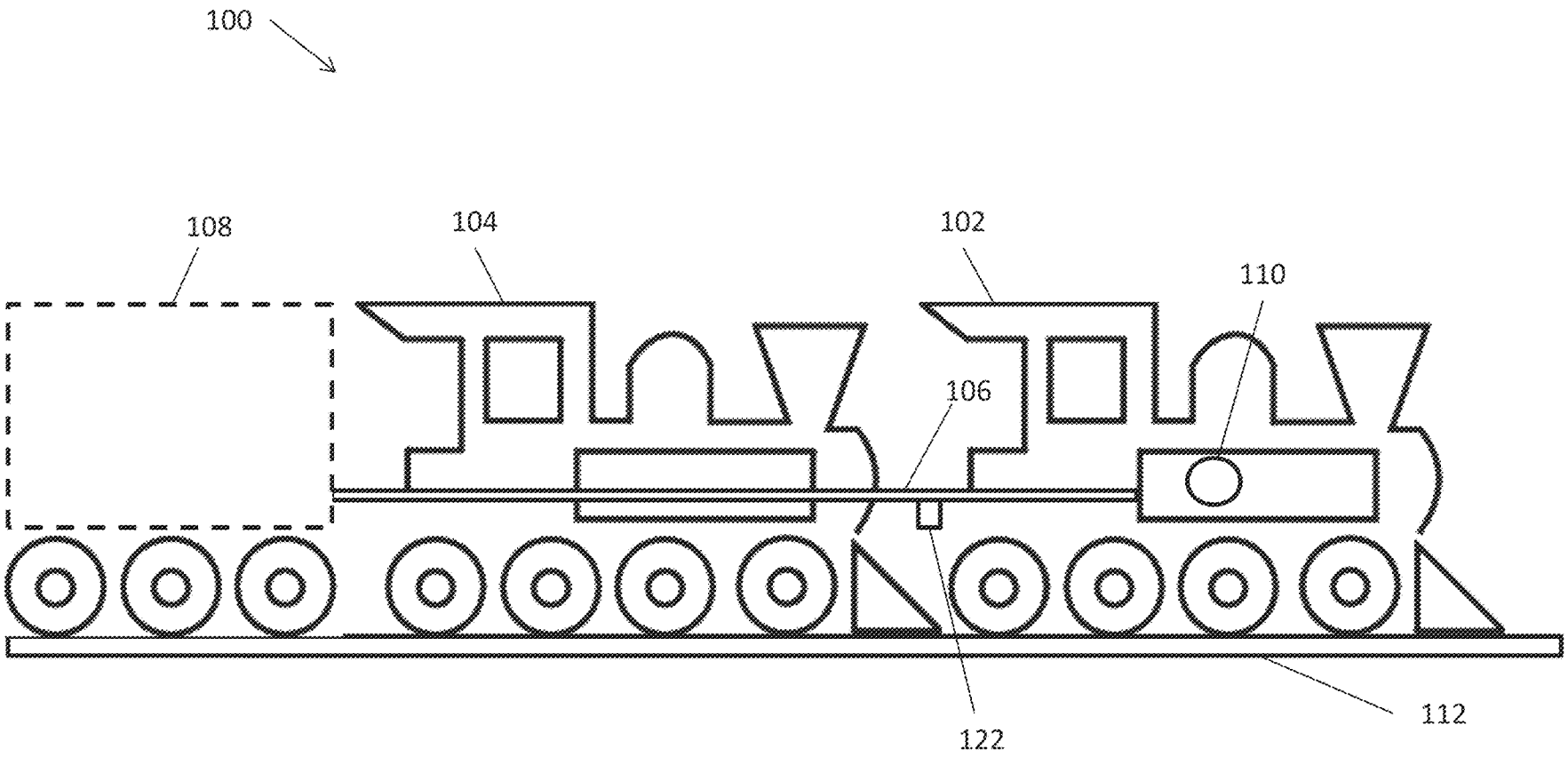
FIG. 1 is a block diagram of a remote control locomotive (RCL) system according to one example embodiment of the present disclosure.

Example embodiments will now be described more fully with reference to the accompanying drawings.

Most rail rolling stock (e.g., locomotives, railroad cars, etc.) utilizes pneumatic braking systems, and by monitoring feedback of key data points during charging and/or discharging cycles of the braking system, inferences to consist or train makeup can be made and then used to change other aspects of processes occurring within an electronic control system of the rail rolling stock.

Disclosed herein are exemplary embodiments of systems and methods for classifying consist and/or train makeup, which may include classifying according to a firmware model of airflow and pressure changes over time, etc. Classification accuracy may depend on variations in precision and accuracy of pneumatic sensors, variations in length of rolling stock, initial state of charge, etc. Portions of the consist that are pneumatically connected to the electronic subsystem may be classified, and multiple system safety checks that can be generated according to classifications derived from these models, etc.

In an example brake pipe modeling embodiment, the locomotive control system may include specified actions that are triggered by predefined events. Example actions taken by the system may include, but are not limited to, monitoring and recording changes in brake pipe airflow and pressure feedback over time during a classification process, estimating a volume of air used to pressurize a brake pipe, classifying a volume of the brake pipe into a predefined category representing a range of railcars that may be pneumatically connected taking into consideration an overall state of charge, etc.

Triggering events may include system startup self-tests, initiation of brake release or penalty recovery, completion of a sensor calibration process, entry into a charge mode, etc. A number of cars having the brake pipe laced may be estimated according to a charge rate, a calculated volume required to charge the train, etc. Individual classifications may have a wide range (e.g., 0 cars or locomotives, 1-5 cars or locomotives, 5-10 cars or locomotives, etc.) when a required overall precision required is low.

The example brake pipe modelling embodiments may be used to prevent brake recovery (e.g., penalty brake recovery, etc.) of a remote control locomotive (RCL) system when pneumatic connections of portable systems are pneumatically cutout from a host locomotive. For example, classifications may include "Connected to Zero Locomotives," "Connected to≥One Locomotive," etc. The system may detect if an insufficient number of cars are pneumatically connected for a specific location when an automated brake pipe reduction is made by the RCL or other electronic system.

In an example consist pneumatic modeling embodiment, the locomotive control system may include specified actions that are triggered by predefined events. Example actions taken by the system include monitoring and recording changes in pressure feedback over time for a pneumatic control connection being classified, comparing a processed pressure/time curve to at least one of multiple reference curves to classify the response into a predefined category, enforcing adjustments in fault detection criteria and for future process variables according to a determined category during a most recent successful classification, etc.

Triggering events may include system startup self-tests, brake recovery tests, brake applications that span an available pressure range (e.g., an entire available pressure range, etc.). A goal of these example processes may be to estimate a number of locomotives in a consist according to an independent apply and release pipe (TARP) or actuating pipe (ACT) charge rate, taking into account differences in locomotive lengths, precision of measuring equipment, sample rates, etc. Reference curves that define different categories may be defined according to field experience, field research, testing, etc.

The example consist pneumatic modeling embodiments may be used to inhibit (e.g., prevent, etc.) brake recovery of a remote control locomotive (RCL) system when pneumatic connections of portable systems are pneumatically cutout from a host locomotive, to inhibit brake recovery of an RCL system when a portable system is pneumatically controlling more locomotives than the pneumatic system is designed to control, to adjust independent brake fault criteria to accommodate different consist lengths by tightening fault criteria to fit a consist length, etc.

Example embodiments may enable new or improved error detection functions for electronic locomotive systems, which may increase overall system safety.

With reference to the figures, FIG. 1 illustrates an example remote control locomotive (RCL) system 100 according to some aspects of the present disclosure. The system 100 includes a consist having a locomotive 102, a locomotive 104, and a pneumatic brake pipe 106. The pneumatic brake pipe 106 may provide a pneumatic connection between the locomotive 102 and the locomotive 104 to facilitate a locomotive braking system.

The system 100 also includes one or more optional rail cars 108. When the locomotives 102 and 104 are connected to one or more rail cars 108, the system 100 may be considered as a train. When the locomotives 102 and 104 are not connected to any rail cars 108, the system 100 may be considered as a consist.

The locomotives 102 and 104 may operate in tandem (e.g., by remote control, etc.), and may require electrical and pneumatic connections (e.g., the pneumatic brake pipe 106, etc.), in order to operate together. Although FIG. 1 illustrates the consist as including two locomotives 102 and 104, other embodiments may include more or less locomotives in the consist, and example methods and system described herein may be used to determine or estimate the number of locomotives in the consist.

Figure 2:
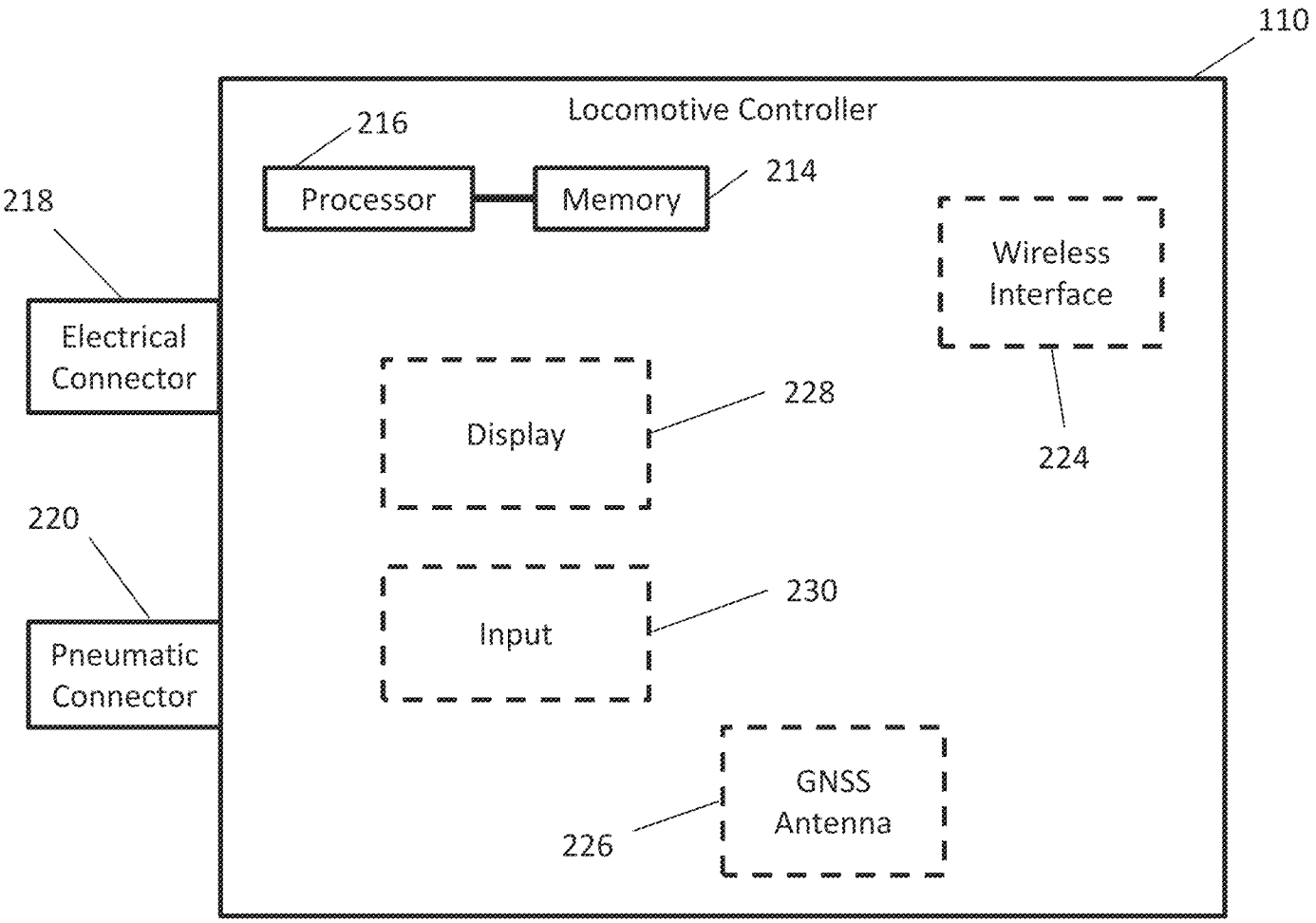
FIG. 2 is a block diagram of the locomotive controller of FIG. 1.

The system 100 also includes an RCL controller 110, which may be configured to control movement of the locomotive 102 along a rail track 112 (e.g., via a tractive effort mechanism, via a pneumatic braking system, etc.). As shown in FIG. 2, the RCL controller 110 may include a memory 214 configured to store computer executable instructions. The memory 214 may store one or more pressurization references (e.g., tables, arrays, models, etc.) including correspondence relationships between pneumatic brake pipe pressurization time periods and pneumatic brake pipe air volumes. For example, the pressurization reference may include a firmware array, a pressurization table may be incorporated into a pressurization model, etc.

The RCL controller 110 includes a processor 216 configured to execute the computer-executable instructions stored in memory 214 to monitor a time period to pressurize the pneumatic brake pipe 106, and compare the monitored time period to pressurize the at least one pneumatic brake pipe 106 to the pressurization reference stored in memory 214. The processor 214 is also configured to determine a fault or a number of locomotives in the consist according to the comparison of the monitored time period to pressurize the at least one pneumatic brake pipe 106 to the pressurization reference stored in memory 214.

The pressurization reference(s) stored in memory 214 may include correspondence relationships between an estimated number of locomotives in the consist and pneumatic brake pipe air volumes. The processor 216 may be configured to store the estimated number of locomotives in the consist in memory 214 according to the comparison of the monitored time period to pressurize the at least one pneumatic brake pipe 106 to the pressurization reference stored in memory 214.

In some embodiments, the processor 216 is configured to determine an air volume of the at least one pneumatic brake pipe 106 according to the comparison of the monitored time period to pressurize the at least one pneumatic brake pipe 106 to the pressurization reference stored in memory 214. The processor 216 may calculate a brake fault timing value according to the determined air volume of the at least one pneumatic brake pipe 106.

The processor 216 may be configured to determine any suitable faults, etc. according to specified criteria. For example, the processor 216 may determine a cutout valve closed fault when the monitored time period to pressurize the at least one pneumatic brake pipe 106 is less than a specified minimum time period threshold, determine an excessive consist length when the monitored time period to pressurize the at least one pneumatic brake pipe 106 is greater than a specified maximum time period threshold, etc.

The processor 216 may monitor the time period to pressurize the at least one pneumatic brake pipe 106 in response to any suitable event, such as a system startup self-test, an initiation of brake release or penalty recovery, a completion of a sensor calibration process, an entry into a charge mode, a brake recovery test, a brake application that spans an available pressure range, etc.

As shown in FIG. 2, the RCL controller 110 includes at least one pneumatic connection 218 for pneumatically coupling the RCL controller 110 to the locomotive 102. The RCL controller 110 also includes at least one electrical connection 220 for electrically coupling the RCL controller 110 to the locomotive 102.

For example, the RCL controller 110 may be a portable RCL controller that connects to an outside of the locomotive 102 to control the locomotive 102. The electrical connection 220 may provide any suitable control functions, such as direction control, throttle/tractive effort control, etc.

The pneumatic connection 218 may be coupled to any suitable pipe, valve, etc. of the locomotive, such as a main reservoir, an independent apply and release pipe (TARP) for controlling locomotive brakes (e.g., only the locomotive brakes), an actuating pipe (ACT), a Brake Pipe (BP) valve, the pneumatic brake pipe 106, etc. The pneumatic brake pipe 106 may control braking effort for the rail cars 108, and may have some effect on locomotive brakes unless the ACT pipe is pressurized, etc.

For example, the pneumatic brake pipe 106 may be connected between multiple rail cars 108. Each rail car 108 may have its own pneumatic brake pipe, but they may not typically be connected or charged in a rail yard. In some cases, the pneumatic brake pipes of the rail cars 108 may be connected to provide braking effort due to tonnage and grade conditions, etc. Each rail car 108 may include a hose (e.g., a single hose) on either side of the rail car 108. The hose may permit charging and applying brakes to the rail car 108, and may feed subsequent rail cars 108 with train brake air. The air pressure may originate at the locomotive 102.

The RCL system 100 may include any suitable sensors, monitors, etc. for measuring pressures, airflows, etc. in the pneumatic brake pipe 106. For example, the RCL system 100 illustrated in FIG. 1 includes an air flow meter 122 coupled with the pneumatic brake pipe 106 to detect a pressure and airflow rate in the pneumatic brake pipe 106.

Depending on an initial state of charge, a length of each rail car 108, a number of rail cars 108, a charge rate, leakage, etc., the volume of air required to provide a true charge of the pneumatic brake pipe 106 may vary. However, a reduced precision in calculating a number of connected rail cars 108 may be acceptable in some situations.

For example, an RCL system automation feature may include rules that instruct rail crews regarding how many rail cars 108 should have their brake pipes connected to ensure that a stopping trajectory the RCL system 100 is attempting to enforce can be met. A model may classify charge volumes into broad categories such as zero cars connected (e.g., laced), 1-5 cars laced, 6-10 cars laced, etc.

If the RCL system 100 is brought online while cutout valves are closed on an independent apply and release pipe, the RCL system 100 may provide tractive effort without controlling braking effort on the locomotive 102. In that case, the locomotive brakes should remain at full application pressure, although the opposite could occur due to operator error. Feedback that the RCL system 100 sees may be satisfied when the feedback point is on the RCL controller side of the cutout valve if a portable RCL controller 110 is used.

In some embodiments, if the TARP cutout valve is set to isolate the RCL controller 110 from the locomotive 102, RCL pressure feedback may reach a commanded set point very quickly, because the RCL controller 110 is controlling a very small volume of air. This setup error can be detected and a fault generated before the RCL controller 110 allows a user to command movement of the locomotive 102. In other embodiments, the ACT pipe may be monitored as an alternative to, or in addition to, the IARP cutout valve.

The processor 216 may be configured to inhibit penalty brake recovery of the RCL system 100 when the pneumatic connection 218 is cut out from locomotive 102. For example, the processor 216 may inhibit penalty brake recovery of the RCL system 100 in response to the processor 216 determining that the RCL controller 110 is controlling more locomotives than a specified locomotive control number of the RCL controller 110.

In some embodiments, the IARP valve may have a diameter of about 0.5 inches with a length of 49 feet, 64 feet, 70 feet, etc., providing a volume of 115 cubic inches, 151 cubic inches, 165 cubic inches, etc. A minimum volume may correspond to a smallest single pipe, such as 115 cubic inches mentioned above. A maximum volume may combine multiple pipes (e.g., three pipes, etc.) to provide a maximum volume of around 495 cubic inches, etc.

The processor 216 may be configured to adjust independent brake fault detection criteria according to the determined number of locomotives in the consist. For example, the processor 216 may dynamically adjust fault detection criteria so that failures of the pneumatic system can be detected earlier when there is a single locomotive, as compared to operating a multiple locomotive consist where pressures will take longer to reach set point due to a larger volume of air required to charge (e.g., pressurize) the pneumatic brake pipe 106.

Referring again to FIG. 2, the RCL controller 110 may include one or more wireless interfaces 224 (e.g., data ports), such as a short-range wireless communication interface, a Wi-Fi wireless communication interface, a cellular communication interface, other radio frequency (RF) interfaces, etc.

The RCL controller 110 may include a global navigation satellite system (GNSS) antenna 226 (e.g., a GPS antenna, etc.), one or more accelerometers (e.g., an accelerometer array, a single accelerometer, etc.), etc. The RCL controller 110 can report a location, one or more parameters, etc. to a wireless network for back office monitoring and data processing.

The RCL controller 110 may include an optional display 228 and an input 230. The optional display 228 can be any suitable display (e.g., a liquid crystal display (LCD), light emitting diodes (LED), indicator lights, etc.). The input 230 can include any suitable input element(s) (e.g., a keypad, touchscreen, switches, etc.), for receiving inputs (e.g., commands, etc.) from an operator.

As described herein, the example RCL controllers may include a microprocessor, microcontroller, integrated circuit, digital signal processor, etc., which may include memory. The RCL controllers may be configured to perform (e.g., operable to perform, etc.) any of the example processes described herein using any suitable hardware and/or software implementation. For example, the RCL controllers may execute computer-executable instructions stored in a memory, may include one or more logic gates, control circuitry, etc.

Figure 3:
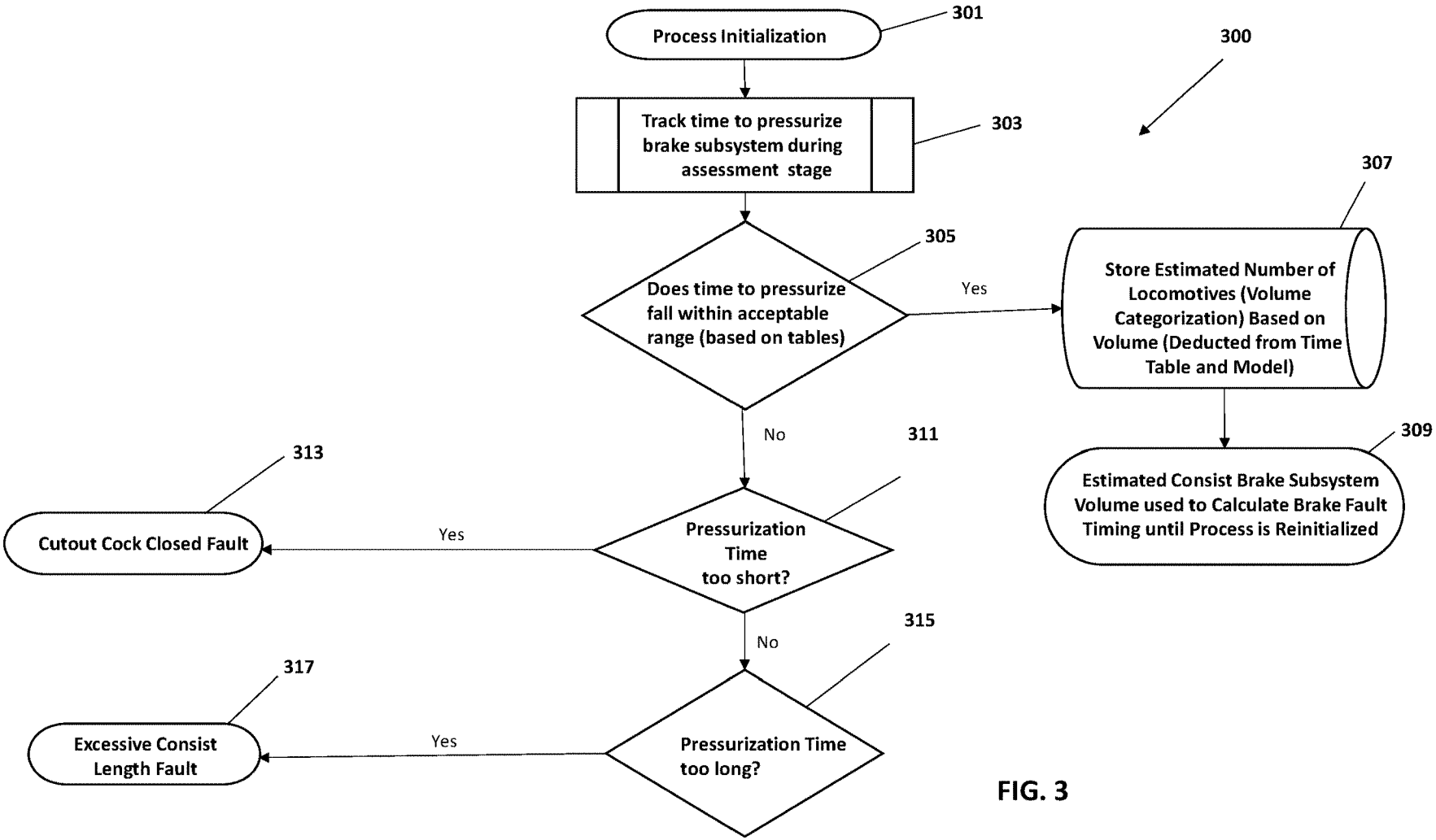
FIG. 3 is a flow chart of a process for determining a fault or a number of locomotives in consist of a remote control locomotive (RCL) system according to another example embodiment of the present disclosure.

FIG. 3 illustrates a flow chart of a process 300 for determining a fault or a number of locomotives in consist of a remote control locomotive (RCL) system according to another example embodiment of the present disclosure. After process initialization at 301, the process monitors a time period to pressurize a pneumatic brake subsystem during an assessment stage at 303.

The process checks whether the monitored time period to pressurize the pneumatic brake subsystem falls within a specified acceptable range at 305 by comparing with stored pressurization references. If the monitored time period falls within the specified acceptable range, a number of estimated locomotives in a consist is stored according to an estimated volume of the pneumatic brake subsystem at 307.

The estimated volume of the pneumatic brake subsystem may be determined according to the monitored time period and one or more pneumatic brake subsystem models, pressurization references, etc. At 309, the estimated volume of the pneumatic brake subsystem is used to calculate a brake fault timing value. The calculated brake fault timing value may be stored until the process 300 is reinitialized.

Referring back to 305, if the monitored time period to pressurize the pneumatic brake subsystem is outside the specified acceptable range, the process 300 may detect one or more faults. For example, at 311 the process determines whether the monitored time period is too short (e.g., less than a lower threshold of the specified acceptable range, etc.). If so, the process 300 may determine that a cutout cock closed fault has occurred at 313.

If the monitored time period is not too short, the process 300 moves to 315. At 315, the process 300 determines whether the monitored time period is too long (e.g., greater than an upper threshold of the specified acceptable range, etc.). If so, the process 300 may determine that an excessive consist length fault has occurred at 317.

Figure 4:
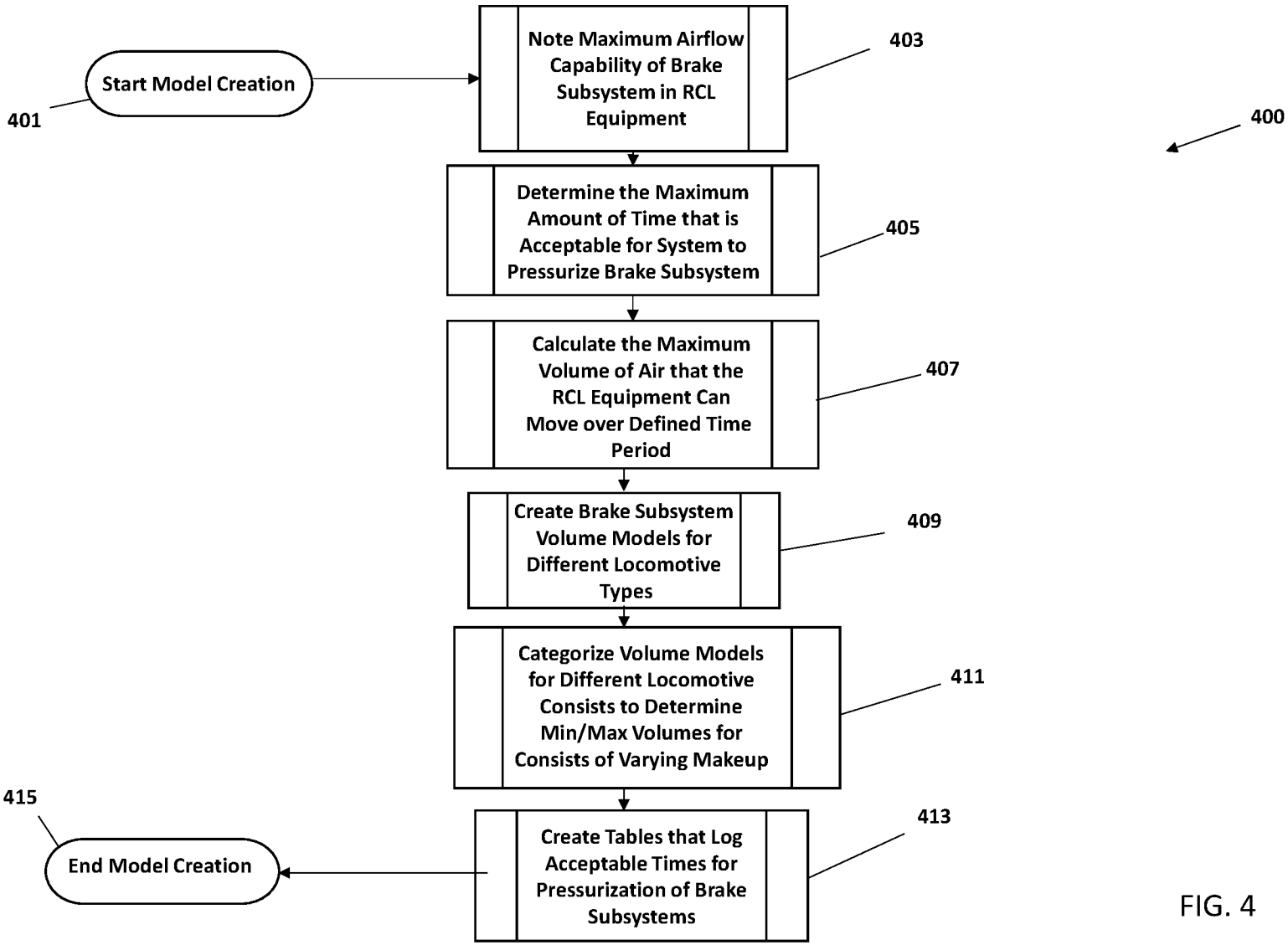
FIG. 4 is a flow chart of a process for pressurization of a pneumatic brake pipe of a remote control locomotive (RCL) system according to another example embodiment of the present disclosure.

FIG. 4 illustrates a flow chart of a process 400 for pressurization of a pneumatic brake pipe of a remote control locomotive (RCL) system according to another example embodiment of the present disclosure. After starting model creation at 401, the process identifies a specified (e.g., maximum, etc.) airflow capability of the brake subsystem in RCL equipment at 403. The specified maximum airflow capability may be different for different braking subsystems, different locomotives, different consists, etc.

The process 400 then determines a specified (e.g., maximum, etc.) allowable time period for the RCL system to pressurize the brake subsystem at 405. The maximum allowable time period may be determined according to locomotive systems engineering, as a safety case, etc.

At 407, a maximum volume of air that the RCL equipment can move during the specified time period is calculated. The maximum volume of air may be calculated according to capabilities of the brake subsystem relative to the specified maximum allowable time period, etc.

Brake subsystem volume models for different locomotive types may be created at 409. At 411, volume models for different locomotive consists are categorized to determine minimum, maximum, etc. volumes for consists of various locomotive makeups. At 413, the process 400 creates references (e.g., tables, arrays, models, etc.) that log acceptable times for pressurization of brake subsystems. The tables may be created according to capabilities of hardware to pressurize volumes in the different consist model categories over the specified time period. Model creation ends at 415.

Figure 5:
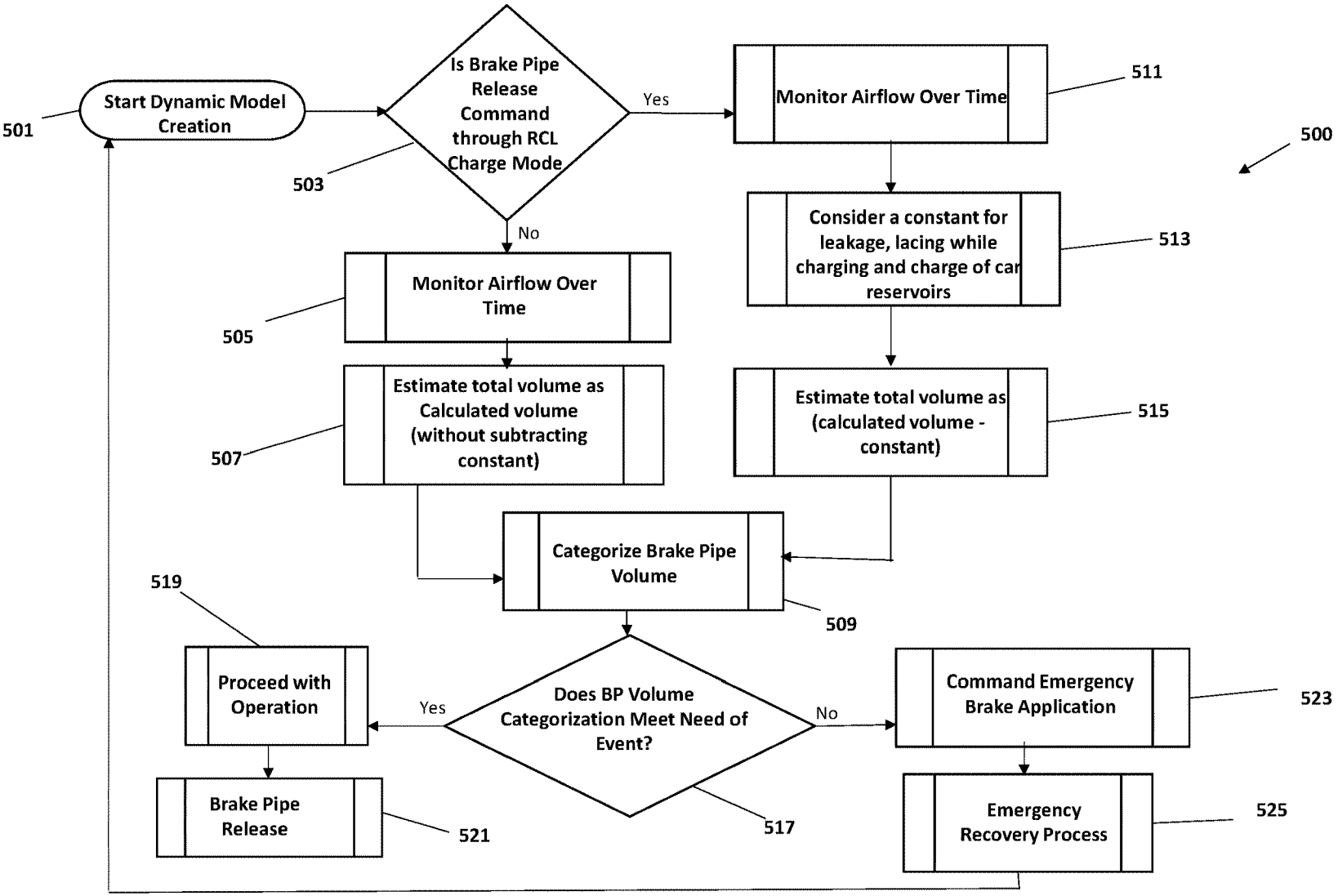
FIG. 5 is a flow chart of a process for controlling one or more locomotives of a remote control locomotive (RCL) system according to another example embodiment of the present disclosure.

FIG. 5 illustrates a flow chart of a process 500 for controlling one or more locomotives of a remote control locomotive (RCL) system according to another example embodiment of the present disclosure. After starting dynamic model creation at 501, the process determines whether a Train Brake release command is initiated through an RCL charge mode at 503. If not, the process monitors air flow over time at 505, estimates a total brake pipe volume according to the monitored air flow over time at 507, and categorizes the brake pipe volume at 509.

Referring back to 503, if the Train Brake release command is received through the RCL charge mode, the process 500 monitors airflow over time at 511 and determines one or more constant values for leakage, lacing while charging, charges of rail car reservoirs, etc., at 513. Then, the estimated total volume of the brake pipe is determined according to a calculated volume minus the one or more constant values at 515, and the brake pipe volume is categorized at 509.

At 517, the process 500 determines whether the brake pipe volume categorization meets a need for a specified event. If yes, the process 500 proceeds with the operation at 519, released the pneumatic brake pipe at 521, and returns to the start of the dynamic model creation at 501.

If the brake pipe volume categorization does not meet the need for the specified event at 517, the process 500 commands an emergency brake application for safety at 523. The process 500 then initiates an emergency recovery process at 525, and returns to the start of the dynamic model creation at 501.

According to another example embodiment, a remote control locomotive (RCL) controller includes a memory configured to store computer-executable instructions for controlling one or more locomotives including at least one pneumatic brake pipe, and a processor configured to execute the computer-executable instructions stored in memory.

The processor is configured to execute the instructions to receive a Train Brake release command and determine whether the received Train Brake release command is received through a remote controlled locomotive (RCL) charge mode, monitor an airflow rate over time associated with the at least one pneumatic brake pipe, and estimate a total volume of the at least one pneumatic brake pipe according to the monitored airflow rate over time.

The processor is also configured to categorize the estimated brake pipe volume and determine whether the categorized brake pipe volume meets a requirement of a specified operation, and proceed with the specified operation or command an emergency brake application in response to determining whether the categorized brake pipe volume meets a requirement of a specified operation.

Proceeding with the specified operation may include proceeding with the specified operation in response to determining that the categorized brake pipe volume meets the requirement of the specified operation, and releasing the at least one pneumatic brake pipe. Commanding the emergency brake application may include commanding the emergency brake application in response to determining that the categorized brake pipe volume does not meet the requirement of the specified operation, and initiating an emergency recovery process.

The processor may be configured to determine a constant value for at least one of pneumatic brake pipe leakage, railroad car lacing while charging, and a charge of car reservoirs, and estimate a total volume of the at least one pneumatic brake pipe may include calculating a total volume of the at least one pneumatic brake pipe according to the monitored airflow rate over time minus the determined constant value.

The categorized brake pipe volume may include at least a first category indicative of zero connected railroad cars, a second category indicative of a first range of connected railroad cars greater than zero, and a third category indicative of a second range of connected railroad cars greater than the first range.

According to another example embodiment, a method for pressurization of a brake subsystem of one or more remote controlled locomotives in a consist is disclosed. The method includes determining a maximum airflow rate of the brake subsystem of the one or more remote controlled locomotives in the consist, determining a specified maximum time period to pressurize the brake subsystem of the one or more remote controlled locomotives in the consist, and calculating a maximum volume of air movable by the brake subsystem over the specified maximum time period.

The method also includes creating multiple brake subsystem volume models, each brake subsystem volume model corresponding to a different one of multiple locomotive types, categorizing volume models for different locomotive consists to determine minimum and maximum volumes for consists having different locomotive makeups, and creating multiple pressurization reference references, each pressurization reference logging a specified allowable time period for pressurization of a corresponding brake subsystem.

In some embodiments, different brake subsystems have different maximum airflow rates, and calculating a maximum volume of air movable by the brake subsystem over the specified maximum time period includes calculating the maximum volume of air according to the determined maximum airflow rate of the brake subsystem relative to the specified maximum time period to pressurize the brake subsystem.

Creating multiple pressurization references may include creating multiple pressurization references according to the calculated maximum volume of air movable by the brake subsystem over the specified maximum time period and the categorized volume models for the one or more locomotives in the consist.

According to yet another example embodiment, an exemplary method of determining a fault or a number of locomotives or cars in a train or consist of a remote control locomotive (RCL) system is disclosed. The train or consist includes at least one locomotive and at least one pneumatic brake pipe.

The exemplary method generally includes storing a pressurization reference including correspondence relationships between pneumatic brake pipe pressurization time periods and pneumatic brake pipe air volumes, and monitoring a time period to pressurize the at least one pneumatic brake pipe of the train or consist.

The method also includes comparing the monitored time period to pressurize the at least one pneumatic brake pipe to the stored pressurization reference, and determining a fault or a number of locomotives or cars in the train or consist according to the comparison of the monitored time period to pressurize the at least one pneumatic brake pipe to the stored pressurization reference.

The pressurization reference may include correspondence relationships between an estimated number of locomotives or train cars and pneumatic brake pipe air volumes, and the method may include storing the estimated number of locomotives or cars in the train or consist in memory according to the comparison of the monitored time period to pressurize the at least one pneumatic brake pipe to the stored pressurization reference.

The estimated number of locomotives or cars may include at least a first category indicative of zero locomotives or cars, a second category indicative of a first range of locomotives or cars greater than zero, and a third category indicative of a second range of locomotives or cars greater than the first range.

The method may include determining an air volume of the at least one pneumatic brake pipe according to the comparison of the monitored time period to pressurize the at least one pneumatic brake pipe to the stored pressurization reference, and calculating a brake fault timing value according to the determined air volume of the at least one pneumatic brake pipe.

In some embodiments, the method includes determining a cutout valve closed fault when the monitored time period to pressurize the at least one pneumatic brake pipe is less than a specified minimum time period threshold, or determining an excessive consist or train length when the monitored time period to pressurize the at least one pneumatic brake pipe is greater than a specified maximum time period threshold.

Monitoring the time period to pressurize the at least one pneumatic brake pipe may include monitoring the time period in response to at least one of a system startup self-test, an initiation of brake release or penalty recovery, a completion of a sensor calibration process, an entry into a charge mode, a brake recovery test, and a brake application that spans an available pressure range.

In some embodiments, the method includes inhibiting penalty brake recovery of the RCL system when the at least one pneumatic connection is cut out from the locomotive, inhibiting penalty brake recovery of the RCL system in response to the processor determining that an RCL controller is controlling more locomotives than a specified locomotive control number of the RCL controller, or adjusting independent brake fault detection criteria according to the determined number of locomotives in the consist.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purposes of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A remote control locomotive (RCL) system comprising:

a consist including at least one locomotive and at least one pneumatic brake pipe; and an RCL controller configured to control the at least one locomotive, the RCL controller comprising:

a memory configured to store computer-executable instructions and at least one pressurization reference including correspondence relationships between pneumatic brake pipe pressurization time periods and pneumatic brake pipe air volumes; and a processor configured to execute the computer-executable instructions stored in the memory to:

monitor a time period to pressurize the at least one pneumatic brake pipe;

compare the monitored time period to pressurize the at least one pneumatic brake pipe to the at least one pressurization reference stored in the memory; and determine a fault or a number of locomotives in the consist according to the comparison of the monitored time period to pressurize the at least one pneumatic brake pipe to the at least one pressurization reference stored in the memory;

wherein the processor is configured to determine a cutout valve closed fault when the monitored time period to pressurize the at least one pneumatic brake pipe is less than a specified minimum time period threshold.

2. The RCL system of claim 1, wherein:

the at least one pressurization reference includes correspondence relationships between an estimated number of locomotives in the consist and pneumatic brake pipe air volumes; and the processor is configured to store the estimated number of locomotives in the consist in the memory according to the comparison of the monitored time period to pressurize the at least one pneumatic brake pipe to the at least one pressurization reference stored in the memory.

3. The RCL system of claim 1, wherein the processor is configured to:

determine an air volume of the at least one pneumatic brake pipe according to the comparison of the monitored time period to pressurize the at least one pneumatic brake pipe to the at least one pressurization reference stored in the memory; and calculate a brake fault timing value according to the determined air volume of the at least one pneumatic brake pipe.

4. The RCL system of claim 1, wherein the processor is configured to determine an excessive consist length when the monitored time period to pressurize the at least one pneumatic brake pipe is greater than a specified maximum time period threshold.

5. The RCL system of claim 1, wherein the processor is configured to monitor the time period to pressurize the at least one pneumatic brake pipe in response to at least one of a system startup self-test, an initiation of brake release or penalty recovery, a completion of a sensor calibration process, an entry into a charge mode, a brake recovery test, and a brake application that spans an available pressure range.

6. The RCL system of claim 1, wherein the RCL controller includes at least one pneumatic connection for coupling to the locomotive and at least one electrical connection for coupling to the locomotive.

7. The RCL system of claim 6, wherein the at least one pneumatic connection of the RCL controller is coupled to at least one of a main reservoir, an independent apply and release pipe (IARP), an actuating pipe (ACT), and a Brake Pipe (BP) valve.

8. The RCL system of claim 7, wherein the processor is configured to inhibit penalty brake recovery of the RCL system when the at least one pneumatic connection is cut out from the at least one locomotive.

9. The RCL system of claim 1, wherein the processor is configured to inhibit penalty brake recovery of the RCL system in response to the processor determining that the RCL controller is controlling more locomotives than a specified locomotive control number of the RCL controller.

10. The RCL system of claim 1, wherein the processor is configured to adjust independent brake fault detection criteria according to the determined number of locomotives in the consist.

11. The RCL system of claim 1, further comprising at least one pressure sensor and at least one airflow meter coupled with the at least one pneumatic brake pipe to detect a pressure and airflow rate in the at least one pneumatic brake pipe.

12. A method for pressurization of a brake subsystem of one or more remote controlled locomotives in a consist, the method comprising:

determining a maximum airflow rate of the brake subsystem of the one or more remote controlled locomotives in the consist;

determining a specified maximum time period to pressurize the brake subsystem of the one or more remote controlled locomotives in the consist;

calculating a maximum volume of air movable by the brake subsystem over the specified maximum time period;

creating multiple brake subsystem volume models, each brake subsystem volume model corresponding to a different one of multiple locomotive types;

categorizing volume models for different locomotive consists to determine minimum and maximum volumes for consists having different locomotive makeups; and creating multiple pressurization references, each pressurization reference logging a specified allowable time period for pressurization of a corresponding brake subsystem.

13. The method of claim 12, wherein:

different brake subsystems have different maximum airflow rates; and calculating a maximum volume of air movable by the brake subsystem over the specified maximum time period includes calculating the maximum volume of air according to the determined maximum airflow rate of the brake subsystem relative to the specified maximum time period to pressurize the brake subsystem.

14. The method of claim 12, wherein creating multiple pressurization references includes creating multiple pressurization references according to the calculated maximum volume of air movable by the brake subsystem over the specified maximum time period and the categorized volume models for the one or more remote controlled locomotives in the consist.

15. A remote control locomotive (RCL) controller comprising:

a memory configured to store computer-executable instructions for controlling one or more locomotives including at least one pneumatic brake pipe; and a processor configured to execute the computer-executable instructions stored in the memory to:

receive a Train Brake release command and determine whether the received Train Brake release command is received through a remote controlled locomotive (RCL) charge mode;

monitor an airflow rate over time associated with the at least one pneumatic brake pipe;

estimate a total volume of the at least one pneumatic brake pipe according to the monitored airflow rate over time;

categorize the estimated brake pipe volume and determine whether the categorized brake pipe volume meets a requirement of a specified operation; and proceed with the specified operation or command an emergency brake application in response to determining whether the categorized brake pipe volume meets a requirement of a specified operation;

wherein the processor is further configured to execute the computer-executable instructions stored in the memory to:

monitor a time period to pressurize the at least one pneumatic brake pipe; and determine a cutout valve closed fault when the monitored time period to pressurize the at least one pneumatic brake pipe is less than a specified minimum time period threshold.

16. The controller of claim 15, wherein proceeding with the specified operation includes:

proceeding with the specified operation in response to determining that the categorized brake pipe volume meets the requirement of the specified operation; and releasing the at least one pneumatic brake pipe.

17. The controller of claim 15, wherein commanding the emergency brake application includes:

commanding the emergency brake application in response to determining that the categorized brake pipe volume does not meet the requirement of the specified operation; and initiating an emergency recovery process.

18. The controller of claim 15, wherein the processor is configured to execute the instructions to determine a constant value for at least one of pneumatic brake pipe leakage, railroad car lacing while charging, and a charge of car reservoirs, wherein estimating a total volume of the at least one pneumatic brake pipe includes calculating a total volume of the at least one pneumatic brake pipe according to the monitored airflow rate over time minus the determined constant value.

19. The controller of claim 15, wherein the categorized brake pipe volume includes at least a first category indicative of zero connected railroad cars, a second category indicative of a first range of connected railroad cars greater than zero, and a third category indicative of a second range of connected railroad cars greater than the first range.

* * * * *